US011739902B2

(12) United States Patent
Fischer et al.

(10) Patent No.: US 11,739,902 B2
(45) Date of Patent: Aug. 29, 2023

(54) ILLUMINATION DEVICE FOR A MOTOR VEHICLE, IN PARTICULAR A HIGH-RESOLUTION HEADLAMP

(71) Applicant: HELLA GMBH & CO. KGAA, Lippstadt (DE)

(72) Inventors: Bernd Fischer, Altenbeken (DE); Alexander Klarius, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/569,200

(22) Filed: Jan. 5, 2022

(65) Prior Publication Data

US 2022/0128209 A1 Apr. 28, 2022

Related U.S. Application Data

(63) Continuation of application No. PCT/EP2020/067863, filed on Jun. 25, 2020.

(30) Foreign Application Priority Data

Jul. 5, 2019 (DE) ..... 10 2019 118 264.6

(51) Int. Cl.

| | |
|---|---|
| ***F21S 41/663*** | (2018.01) |
| ***F21S 41/25*** | (2018.01) |
| ***F21S 41/153*** | (2018.01) |
| ***F21S 41/683*** | (2018.01) |
| ***F21S 41/43*** | (2018.01) |

(52) U.S. Cl.

CPC ..... *F21S 41/663* (2018.01); *F21S 41/153* (2018.01); *F21S 41/25* (2018.01); *F21S 41/43* (2018.01); *F21S 41/683* (2018.01)

(58) Field of Classification Search

None

See application file for complete search history.

(56) References Cited

U.S. PATENT DOCUMENTS

| | | | |
|---|---|---|---|
| 2002/0044261 | A1 | 4/2002 | Ouchi et al. |
| 2022/0010940 | A1 | 1/2022 | Schneider et al. |

FOREIGN PATENT DOCUMENTS

| | | | |
|---|---|---|---|
| DE | 102004014900 | A1 | 6/2005 |
| DE | 102009051375 | A1 | 5/2011 |
| DE | 102018115045 | A1 | 12/2018 |
| DE | 102018008760 | A1 | 4/2019 |
| GB | 203774 | A | 9/1923 |
| KR | 1020140043636 | A | 4/2014 |

OTHER PUBLICATIONS

International Search Report dated Oct. 12, 2020 in corresponding application PCT/EP2020/067863.

*Primary Examiner* — Elmito Breval

(74) *Attorney, Agent, or Firm* — Muncy, Geissler, Olds & Lowe, P.C.

(57) ABSTRACT

An illumination device for a motor vehicle, in particular a high-resolution headlamp, comprising an imaging component with an active surface at which imaging elements are arranged in the manner of a matrix for the specific creation of pixels of a light distribution, projection optics by means of which the light coming from the active surface is projected into the space outside the motor vehicle in operation of the illumination device, wherein the illumination device has an aperture diaphragm with a variable opening width through which at least part of the light coming from the active surface can pass in operation of the illumination device.

10 Claims, 1 Drawing Sheet

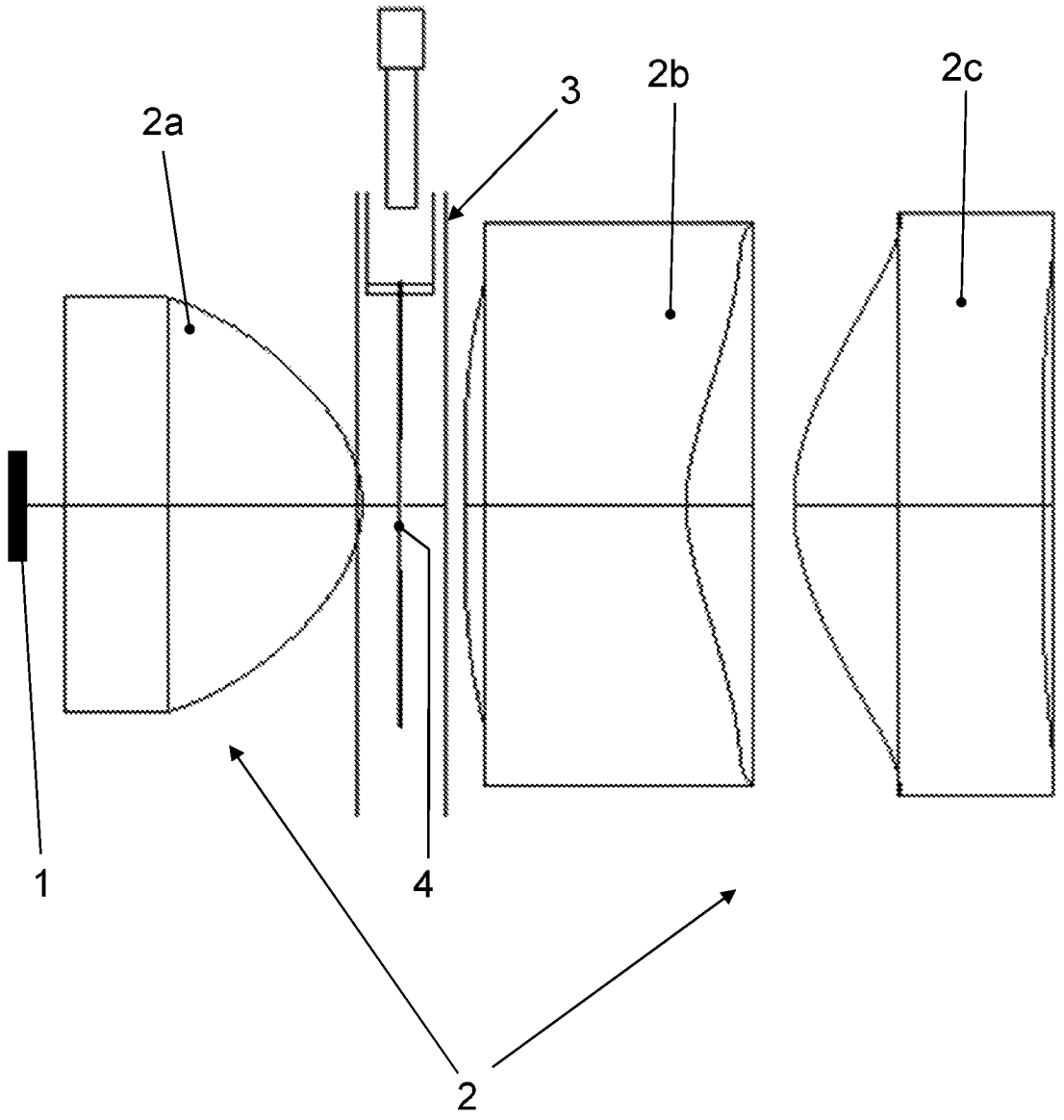
2a
3
2b
2c
1
4
2

ILLUMINATION DEVICE FOR A MOTOR VEHICLE, IN PARTICULAR A HIGH-RESOLUTION HEADLAMP

This nonprovisional application is a continuation of International Application No. PCT/EP2020/067863, which was filed on Jun. 25, 2020, and which claims priority to German Patent Application No. 10 2019 118 264.6, which was filed in Germany on Jul. 5, 2019, and which are both herein incorporated by reference.

BACKGROUND OF THE INVENTION

Field of the Invention

The present invention relates to an illumination device for a motor vehicle, in particular a high-resolution headlamp, as well as to a method for operating such an illumination device.

Description of the Background Art

An illumination device is known from DE 10 2018 115 045 A1. The illumination device described therein can be designed as a high-resolution headlamp of a motor vehicle or as street lighting, for example. The illumination device includes a digital micromirror device that serves as an imaging component and is exposed to light from a light source. The illumination device additionally includes projection optics by means of which the light coming from the imaging component can be projected into the space outside the illumination device. In particular, the imaging component can be controlled such that symbols are projected onto the road by the illumination device designed as a street light, for example.

When the intent is to realize an adaptive or glare-free high beam with comparable headlamps, it is advantageous to realize a high maximum illumination intensity of the light distribution created. In contrast, when the intent is for welcome scenarios or symbol projections to be produced, high imaging quality is required. In the prior art, no illumination devices of the initially mentioned type are known in which either a high maximum illumination intensity or a high imaging quality can be achieved depending on the application.

SUMMARY OF THE INVENTION

It is therefore an object of the present invention to provide an illumination device of the initially mentioned type that can be adjusted flexibly to different requirements. In addition, a method is to be specified for operating such an illumination device.

According to an example, provision is made that the illumination device has an aperture diaphragm with a variable opening width through which at least part of the light coming from the active surface can pass in operation of the illumination device. The aperture diaphragm can be an iris diaphragm, for example. An aperture diaphragm with variable opening width makes it possible to optimize the light distribution produced by the illumination device as a function of the application. When a high beam is to be produced, the opening width can be chosen to be large in order to allow the maximum illumination intensity to be as high as possible. But when a projection of one or more symbols onto the roadway is to be performed, however, the opening width can be chosen to be small in order to achieve the highest imaging quality possible. As a result, a headlamp module, in particular, is realized that can have both a high maximum illumination intensity and a high imaging quality.

Provision can be made that the illumination device includes a drive that, for example, has an electric motor, wherein the drive can change the opening width of the aperture diaphragm in operation of the illumination device. In this way, the opening width of the aperture diaphragm can be adjusted to the application in a short time when there are rapidly changing different applications.

The possibility exists that the aperture diaphragm is arranged such that the light that has passed through the aperture diaphragm impinges on at least a part of the projection optics and is projected therefrom into the space outside the motor vehicle. For example, the aperture diaphragm can be arranged behind a first part of the projection optics and ahead of a second part of the projection optics in the propagation direction of the light coming from the active surface. The possibility absolutely exists to arrange the aperture diaphragm entirely ahead of or behind the projection optics, however.

Provision can be made that the illumination device is designed such that the light projected into the space outside the motor vehicle at a first opening width of the aperture diaphragm has a first maximum illumination intensity as well as a first imaging quality, and that the light projected into the space outside the motor vehicle at a second opening width of the aperture diaphragm has a second maximum illumination intensity as well as a second imaging quality, wherein the first opening width of the aperture diaphragm is larger than the second opening width of the aperture diaphragm, wherein the first maximum illumination intensity is higher than the second maximum illumination intensity, and wherein the first imaging quality is poorer than the second imaging quality. In this connection, a decrease in the imaging quality due to a large opening width of the aperture diaphragm for producing a high maximum illumination intensity is tolerated, whereas a reduction of the maximum illumination intensity is accepted in the case of a small opening width of the aperture diaphragm for producing a symbol projection with high imaging quality.

The possibility exists that the imaging elements at the active surface are designed as light-emitting diodes or as laser diodes, in particular wherein the imaging component is a solid state LED array. Alternatively, provision can be made that the imaging component is designed as a digital micromirror device or as an LCoS or as an LC display, or that the imaging component includes a digital micromirror device or an LCoS or an LC display. In this case, the illumination device can include at least one light source, the light of which impinges on the imaging component and is selectively reflected or transmitted by the same in order to create a light distribution.

Further, provision can also be made that the opening width of the aperture diaphragm is chosen to be larger for producing a high beam than for producing a symbol projection on the roadway.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which are given by way of illustration only, and thus, are not limitive of the present invention, and wherein the sole FIGURE shows a schematic side view of part of an illumination device according to the invention.

DETAILED DESCRIPTION

The exemplary embodiment of an illumination device according to the invention depicted in the FIGURE is designed as a high-resolution headlamp and includes an imaging component 1—which is only schematically indicated—as well as projection optics 2. In the exemplary embodiment depicted, the projection optics 2 have three lenses 2*a*, 2*b*, 2*c* that are spaced apart from one another, and through which the light coming from the imaging component 1 can pass sequentially.

The possibility absolutely exists for the projection optics 2 to be designed differently, for example with more or fewer lenses. A construction of the projection optics using mirrors or using lenses and mirrors is likewise possible.

The imaging component 1 has an active surface with imaging elements arranged in the manner of a matrix that are used to specifically create pixels of a light distribution. Provision can be made that the imaging elements at the active surface 3 are designed as light-emitting diodes (LED) or as laser diodes. In particular, the imaging component 1 can be a solid state LED array. The light coming from the individual light-emitting diodes can then be projected into the space outside the motor vehicle by the projection optics 2.

Alternatively, provision can be made that the imaging component 1 is designed as a digital micromirror device (DMD) or as an LCoS or as an LC display, or that the imaging component 1 includes a digital micromirror device or an LCoS or an LC display. For example, in the case of a digital micromirror device, the individual mirror elements serve as imaging elements.

In the case of this alternative design of the imaging component 1 as a digital micromirror device or as an LCoS or as an LC display, the illumination device additionally includes at least one light source (not depicted), the light of which impinges on the imaging component and is selectively reflected or transmitted by the same in order to create a corresponding light distribution.

Also in this design of the imaging component 1, the light coming from the individual imaging elements is projected into the space outside the motor vehicle by the projection optics 2.

The exemplary embodiment of an illumination device according to the invention depicted in FIG. 1 additionally includes an aperture diaphragm 3 with an opening 4, the opening width of which is variable. The aperture diaphragm 3 is designed, in particular, as an iris diaphragm. The aperture diaphragm 3 is shown as a mechanically adjustable iris diaphragm in the schematic illustration. However, the aperture diaphragm 3 can, in particular, be connected to an electric motor or comparable drive in order to permit a change in the opening width during operation of the illumination device.

The center of the opening 4 of the aperture diaphragm 3 is arranged on the optical axis 5 of the projection optics 2.

In the schematic diagram, the aperture diaphragm 3 is arranged between the first lens 2*a*, which is adjacent to the imaging component 1, and the other two lenses 2*b* and 2*c* of the projection optics 2. However, the possibility absolutely exists to arrange the aperture diaphragm 3 at another location in the projection optics 2 or to arrange the aperture diaphragm 3 entirely ahead of or behind the projection optics 2. What is important here is that the aperture diaphragm 3 is arranged behind the imaging component 1 in the propagation direction of the light so that the light beam coming from the imaging component 1 can be clipped at the edges by the aperture diaphragm 3.

The aperture diaphragm 3 with variable opening width makes it possible to optimize the light distribution produced by the illumination device as a function of the application. When a high beam is to be produced, the opening width can be chosen to be large in order to allow the maximum illumination intensity to be as high as possible. But when a projection of one or more symbols onto the roadway is to be performed, however, the opening width can be chosen to be small in order to achieve the highest imaging quality possible.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An illumination device for a motor vehicle, in particular a high-resolution headlamp, the illumination device comprising:

an imaging component with an active surface at which imaging elements are arranged in the manner of a matrix to create pixels of a light distribution;

projection optics via which light coming from the active surface is projected into a space outside the motor vehicle in operation of the illumination device; and an aperture diaphragm with a variable opening width through which at least part of the light coming from the active surface is adapted to pass in operation of the illumination device, wherein the aperture diaphragm is arranged behind a first part of the projection optics and ahead of a second part of the projection optics in the propagation direction of the light coming from the active surface.

2. The illumination device according to claim 1, wherein the aperture diaphragm is an iris diaphragm.

3. The illumination device according to claim 1, wherein the illumination device includes a drive that has an electric motor, wherein the drive is adapted to change the opening width of the aperture diaphragm in operation of the illumination device.

4. The illumination device according to claim 1, wherein the aperture diaphragm is arranged such that the light that has passed through the aperture diaphragm impinges on at least the second part of the projection optics and is projected therefrom into the space outside the motor vehicle.

5. An illumination device for a motor vehicle, in particular a high-resolution headlamp, the illumination device comprising:

an imaging component with an active surface at which imaging elements are arranged in the manner of a matrix to create pixels of a light distribution;

projection optics via which light coming from the active surface is projected into a space outside the motor vehicle in operation of the illumination device; and an aperture diaphragm with a variable opening width through which at least part of the light coming from the active surface is adapted to pass in operation of the illumination device, wherein the illumination device is designed such that the light projected into the space outside the motor vehicle at a first opening width of the aperture diaphragm has a first maximum illumination intensity as well as a first imaging quality, and wherein the light projected into the space outside the motor vehicle at a second opening width of the aperture diaphragm has a second maximum illumination intensity as well as a second imaging quality, wherein the first opening width of the aperture diaphragm is larger than the second opening width of the aperture diaphragm, wherein the first maximum illumination intensity is higher than the second maximum illumination intensity, and wherein the first imaging quality is poorer than the second imaging quality.

6. The illumination device according to claim 1, wherein the imaging elements at the active surface are designed as light-emitting diodes or as laser diodes.

7. An illumination device for a motor vehicle, in particular a high-resolution headlamp, the illumination device comprising:

an imaging component with an active surface at which imaging elements are arranged in the manner of a matrix to create pixels of a light distribution;

projection optics via which light coming from the active surface is projected into a space outside the motor vehicle in operation of the illumination device; and an aperture diaphragm with a variable opening width through which at least part of the light coming from the active surface is adapted to pass in operation of the illumination device, wherein the imaging component is designed as a digital micromirror device or as an LCoS or as an LC display, or wherein the imaging component includes a digital micromirror device or an LCoS or an LC display.

8. The illumination device according to claim 1, wherein the illumination device includes at least one light source, the light of which impinges on the imaging component and is selectively reflected or transmitted by the same imaging component in order to create the light distribution.

9. A method for operating an illumination device according to claim 1, wherein the opening width of the aperture diaphragm is chosen to be larger for producing a high beam than for producing a symbol projection on the roadway.

10. The illumination device according to claim 1, wherein the imaging component is a solid state LED array.

* * * * *